US008547388B2

(12) United States Patent
Cheng

(10) Patent No.: US 8,547,388 B2
(45) Date of Patent: Oct. 1, 2013

(54) IMAGE PROCESSING DEVICE AND RELATED METHOD THEREOF

(75) Inventor: Ting-Yuan Cheng, Taipei County (TW)

(73) Assignee: Primax Electronics Ltd., Neihu, Taipei (TW)

( * ) Notice: Subject to any disclaimer, the term of this patent is extended or adjusted under 35 U.S.C. 154(b) by 777 days.

(21) Appl. No.: 12/700,724

(22) Filed: Feb. 5, 2010

(65) Prior Publication Data

US 2011/0043534 A1 Feb. 24, 2011

(30) Foreign Application Priority Data

Aug. 21, 2009 (TW) ..... 98128174 A

(51) Int. Cl.
*G09G 5/02* (2006.01)

(52) U.S. Cl.
USPC ..... 345/589

(58) Field of Classification Search
None
See application file for complete search history.

(56) References Cited

U.S. PATENT DOCUMENTS 5,404,178 A * 4/1995 Kondo et al. ..... 348/618
5,724,456 A * 3/1998 Boyack et al. ..... 382/274
5,915,044 A * 6/1999 Gardos et al. ..... 382/236
2002/0071132 A1* 6/2002 Yamada et al. ..... 358/1.9
2004/0060820 A1* 4/2004 Bressler ..... 204/547
2005/0002566 A1* 1/2005 Di Federico et al. ..... 382/176
2005/0041139 A1* 2/2005 Lowles ..... 348/362
2005/0201634 A1* 9/2005 Yuan et al. ..... 382/274
2006/0213998 A1* 9/2006 Liu ..... 235/462.17
2007/0115386 A1* 5/2007 Wakabayashi ..... 348/362
2007/0146494 A1* 6/2007 Goffin et al. ..... 348/222.1
2008/0285655 A1* 11/2008 Au et al. ..... 375/240.16
2009/0066718 A1* 3/2009 Russell et al. ..... 345/595
2009/0207431 A1* 8/2009 Imai ..... 358/1.9
2009/0290052 A1* 11/2009 Liu et al. ..... 348/277
2009/0323814 A1* 12/2009 Takeda et al. ..... 375/240.16
2010/0177203 A1* 7/2010 Lin ..... 348/222.1

* cited by examiner

*Primary Examiner* — Ke Xiao
*Assistant Examiner* — Kyle Zhai
(74) *Attorney, Agent, or Firm* — Winston Hsu; Scott Margo

(57) ABSTRACT

An image processing apparatus and related method determine an ambient luminance value. Ambient luminance value is analyzed under three conditions: static, dynamic and backed-lighted. Image(s) are received in an image stream and different parts of pixel luminance values corresponding to the image(s) selected by different ways are averaged to generate several luminance averaging values, to therefore determine the ambient luminance value from several luminance averaging values.

10 Claims, 10 Drawing Sheets

IMAGE PROCESSING DEVICE AND RELATED METHOD THEREOF

BACKGROUND OF THE INVENTION

1. Field of the Invention

The present invention relates to image processing techniques, and more particularly, to an image processing device and an image processing method thereof for determining the ambient luminance value in the surroundings of an image according to pixel luminance information captured by the image capturing device, wherein the ambient luminance value can further be used to configure other hardware.

2. Description of the Prior Art

In recent years, the design of electronic devices has become more elaborate than before. For example, to achieve better displaying effect on a LCD monitor in different ambient lighting conditions, auto brightness control for adjusting the brightness is employed. The LCD monitor adjusts the brightness of the back light source according to the intensity of ambient lighting detected by an inside ambient light sensor. With the help of the ambient light sensor, an auto-brightness control device in the LCD monitor can dynamically adjust the brightness of the back light source, thereby improving the display effect. Moreover, for a laptop, to ensure a user can use the keyboard in an environment that has a lack of lighting, the manufacturer installs a back light source behind the keyboard to provide the user with adequate lighting for distinguishing symbols on the keys. However, the back light source of the keyboard or LCD monitor may cause additional power consumption. Therefore, the manufacture also has to introduce an auxiliary mechanism of detecting ambient lighting and controlling the switching of the back light source for power saving since the back light source of the LCD monitor or the keyboard is not always necessary, especially in a bright environment. Therefore, the auto brightness control device needs an additional ambient light sensor. Although this additional sensor increases convenience, it also increases the hardware costs.

SUMMARY OF THE INVENTION

With this in mind, it is one objective of the present invention to provide a technique of analyzing ambient lighting and deriving the ambient luminance value without utilizing the ambient light sensor or any other luminance detecting device. The present invention utilizes an image capturing device (e.g. a webcam) embedded in an electronic device for capturing images and then analyzing the captured images in order to derive ambient luminance information from these images. Thus, the present invention can make an electronic device having a webcam be able to analyze ambient lighting without utilizing an additional ambient light sensor so that the electronic device only having the webcam can also have the same ambient lighting detection capability as an electronic device having the ambient light sensor.

According to a first exemplary embodiment of the inventive image processing method, the inventive image processing method includes: generating a plurality of block luminance values respectively corresponding to a plurality of blocks of an image among an input image stream according to a plurality of luminance values respectively corresponding to a plurality of pixels in the plurality of blocks; determining a first characteristic luminance value corresponding to the image according to a relationship between the plurality of block luminance values and an upper luminance threshold, and a relationship between the plurality of block luminance values and a lower luminance threshold; determining a second characteristic luminance value corresponding to the image according to the plurality of luminance values respectively corresponding to the plurality of pixels of the plurality blocks of the image; and utilizing a determining circuit to determine an ambient luminance value according to the first and second characteristic luminance values.

According to a second exemplary embodiment of the inventive image processing method, the inventive image processing method includes: generating a plurality of first block luminance values respectively corresponding to a plurality of first blocks of a first image among an input image stream according to a plurality of first luminance values respectively corresponding to a plurality of pixels in the plurality of first blocks; generating a plurality of second block luminance values respectively corresponding to a plurality of second blocks of a second image among an input image stream according to a plurality of second luminance values respectively corresponding to a plurality of pixels in the plurality of second blocks; respectively generating a plurality of block luminance difference values according to the plurality of first block luminance values and the plurality of second block luminance values; determining each block of the plurality of first blocks is either a static block or a dynamic block according to the plurality of block luminance difference values and at least one dynamic reference value; determining a foreground luminance value according to at least one block luminance value corresponding to a dynamic block and determining a background luminance value according to at least one block luminance value corresponding to a static block; generating a first characteristic luminance value corresponding to the first image according to the plurality of first luminance values; and utilizing a determining circuit to determine an ambient luminance value according to the first characteristic luminance value, the foreground luminance value and the background luminance value.

According to a third exemplary embodiment of the inventive image processing method, the inventive image processing method includes: generating a plurality of block luminance values respectively corresponding to a plurality of blocks of an image in an input image stream according to a plurality of luminance values respectively corresponding to a plurality of pixels in the plurality of blocks; determining whether to configure a block of the plurality of blocks as a back-lighted block by utilizing a back-lighted reference value and the plurality of block luminance values; and utilizing a plurality of block luminance values corresponding to a plurality of back-lighted blocks to determine an ambient luminance value when a number of the back-lighted blocks is greater than a specific value.

According to a first exemplary embodiment of the inventive image processing device, the inventive image processing device includes: a block luminance value generation circuit, a first characteristic luminance value calculation circuit, a second characteristic luminance value calculation circuit, and a determining circuit. The block luminance value generation circuit is utilized for generating a plurality of block luminance values respectively corresponding to a plurality of blocks of an image among an input image stream according to a plurality of luminance values respectively corresponding to a plurality of pixels of the plurality of blocks. The first characteristic luminance value calculation circuit is coupled to the block luminance value generation circuit, and utilized for determining a first characteristic luminance value corresponding to the image according to a relationship between the plurality of block luminance values and an upper luminance threshold, and a relationship between the plurality of block luminance values and a lower luminance threshold. The second characteristic luminance value calculation circuit is utilized for determining a second characteristic luminance value corresponding to the image according to the plurality of luminance values respectively corresponding to the plurality of pixels of the plurality blocks of the image. The determining circuit is coupled to the first characteristic luminance value calculation circuit and the second characteristic luminance value calculation circuit, and utilized for determining an ambient luminance value according to the first and second characteristic luminance values.

According to a second exemplary embodiment of the inventive image processing device, the inventive image processing device includes: a first block luminance value generation circuit, a second block luminance value generation circuit, a difference value calculation circuit, a dynamic block determining circuit, a foreground luminance value calculation circuit, a background luminance value calculation circuit, a characteristic luminance value calculation circuit and a determining circuit. The first block luminance value generation circuit is utilized for generating a plurality of first block luminance values respectively corresponding to a plurality of first blocks of a first image among an input image stream according to a plurality of first luminance values respectively corresponding to a plurality of pixels in the plurality of first blocks. The second block luminance value generation circuit is utilized for generating a plurality of second block luminance values respectively corresponding to a plurality of second blocks of a second image among the input image stream according to a plurality of second luminance values respectively corresponding to a plurality of pixels in the plurality of second blocks. The difference value calculation circuit is coupled to the first block luminance value generation circuit and the second block luminance value generation circuit, and utilized for respectively generating a plurality of block luminance difference values according to the plurality of first block luminance values and the plurality of second block luminance values. The dynamic block determining circuit is coupled to the difference value calculation circuit, and utilized for determining each block of the plurality of first blocks is either a static block or a dynamic block according to the plurality of block luminance difference values and at least one dynamic reference value, and utilized for temporarily storing a determination result and the plurality of first block luminance values. The foreground luminance value calculation circuit is coupled to the dynamic block determining circuit, and utilized for determining a foreground luminance value according to at least one block luminance value corresponding to a dynamic block. The background luminance value calculation circuit is coupled to the dynamic block determining circuit, and utilized for determining a background luminance value according to at least one block luminance value corresponding to a static block. The characteristic luminance value calculation circuit is utilized for generating a characteristic luminance value corresponding to the first image according to the plurality of first luminance values. The determining circuit is coupled to the foreground luminance value calculation circuit, the background luminance value calculation circuit, and the characteristic luminance value calculation circuit, and utilized for determining an ambient luminance value according to the characteristic luminance value, the foreground luminance value and the background luminance value.

According to a third exemplary embodiment of the inventive image processing device, the inventive image processing device includes: a block luminance value generation circuit, a back-lighted block determination circuit, and a back-lighted luminance value calculation circuit. The block luminance value generation circuit is utilized for generating a plurality of block luminance values respectively corresponding to a plurality of blocks of an image among an input image stream according to a plurality of luminance values respectively corresponding to a plurality of pixels in the plurality of blocks. The back-lighted block determination circuit is coupled to the block luminance value generation circuit, and utilized for determining whether to configure a block of the plurality of blocks as a back-lighted block by utilizing a back-lighted reference value and the plurality of block luminance values. The a back-lighted luminance value calculation circuit is coupled to the block luminance value generation circuit and the back-lighted block determination circuit, and utilized for utilizing a plurality of block luminance values corresponding to a plurality of back-lighted blocks to determine an ambient luminance value when a number of the back-lighted blocks is greater than a specific value.

These and other objectives of the present invention will no doubt become obvious to those of ordinary skill in the art after reading the following detailed description of the preferred embodiment that is illustrated in the various figures and drawings.

DETAILED DESCRIPTION

The main concept of the inventive image processing technique involves three different types of ambient lighting analysis, which are static ambient lighting analysis, dynamic ambient lighting analysis, and back-lighted ambient lighting analysis. However, any other analysis technique utilizing at least one concept of the above three ambient lighting analyses should be considered as conforming to the spirit of the present invention and therefore also falls within the present invention's scope.

The static ambient lighting analysis is applied under the condition that there is no dynamic light source or object in the surroundings. Pixel luminance information recorded in a single image is analyzed. The dynamic ambient lighting analysis is applied under the condition that dynamic light sources or objects may exist in the surroundings. Pixel luminance information respectively recorded in two different images, which are chronological in a same image stream, is analyzed. The back-lighted ambient lighting analysis is applied under the condition that the light source is covered or sheltered by an object in the surroundings. In the present invention, in order to reduce the computational overhead of image processing, these analyses utilize a pixel block (which contains a plurality of pixels) as a computation unit for performing ambient lighting analysis and image processing. Please note that there is no limitation in the size of the pixel block (hereinafter designated 'block') utilized by the present invention. For instances, the size of the block may be 2×2 (including 4 pixels), 3×3 (including 9 pixels), or 4×5 (including 20 pixels). Thus, those skilled in the art should be able to implement the analysis techniques of the present invention with blocks of different sizes while retaining the teachings of the present invention.

A first exemplary embodiment of the inventive image processing method provides a way of static ambient lighting analysis for static surroundings. At first, a plurality of block luminance values respectively corresponding to a plurality of blocks (including several pixels) of an image among an input image stream are generated according to a plurality of luminance values respectively corresponding to a plurality of pixels in the plurality of blocks. In this exemplary embodiment, the block luminance value is generated by accumulating all the pixel luminance values corresponding to pixels contained in the block. However, any other computation for generating the block luminance value based on the pixel luminance information should also be considered as falling within the scope of the present invention. Then, once each block luminance value of the image is generated, the present invention performs static lighting analysis according to these block luminance values.

Figure 1:
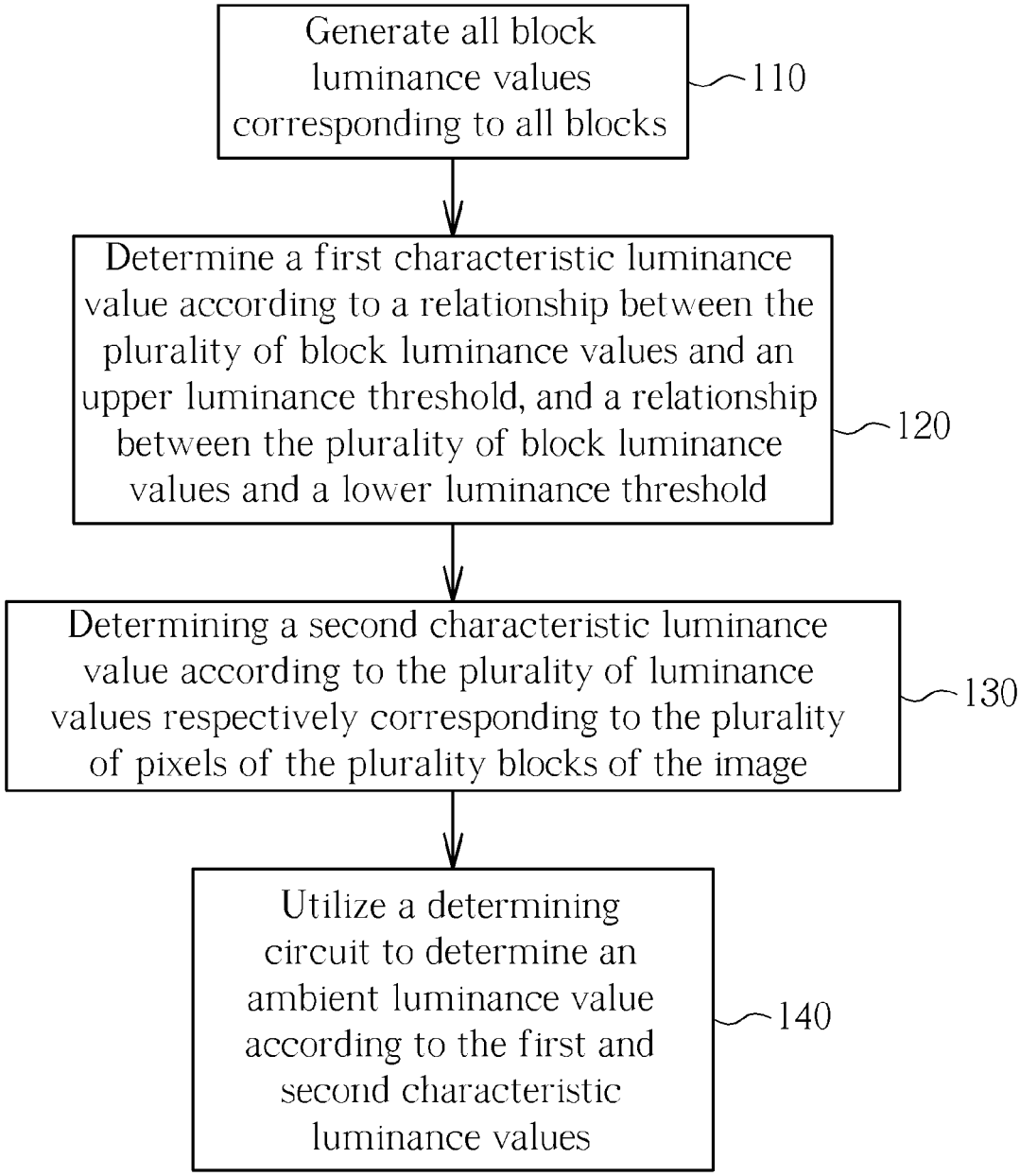
FIG. 1 is a flow chart representing a first exemplary embodiment of the inventive image processing method.

Please refer to FIG. 1, which depicts a flow chart of a first exemplary embodiment of the inventive image processing method. As shown in FIG. 1, all block luminance values are generated in step 110. Then, a first characteristic luminance value is generated in step 120, which is determined according to a relationship between the plurality of block luminance values and an upper luminance threshold, and a relationship between the plurality of block luminance values and a lower luminance threshold. Preferably, step 120 further includes several sub-steps, which are: (step 120*a*) configuring each block in the plurality of blocks whose block luminance value is greater than the upper luminance threshold as a light part block; (step 120*b*) configuring each block in the plurality of blocks whose block luminance value is smaller than the lower luminance threshold as a dark part block; and (step 120*c*) performing a weighted average calculation upon at least one block luminance value corresponding to a light part block and at least one block luminance value corresponding to a dark part block to generate the first characteristic luminance value. In the step 120*a*, all the block luminance values are compared with the upper luminance threshold. If a block has a block luminance value greater than the upper luminance threshold, the block is configured as a light part block; otherwise, the block is not configured. When all comparisons with the upper luminance threshold are finished, the flow goes to step 120*b*, which further compares each block luminance value with the lower luminance threshold and accordingly determines whether a block is configured as a dark part block or not. Once all the blocks are individually compared with the upper and lower luminance thresholds, the flow goes to step 120*c*, which utilizes the block luminance values of the dark/light part blocks which are configured in the former two sub-steps to perform a weighted average calculation. Subsequently, the first characteristic luminance value can be obtained. In short, in the plurality of blocks, only when the block is light or dark to a certain extent will its corresponding block luminance value be utilized to calculate the first characteristic luminance value. That is, those blocks that are not particularly light or dark are not taken into account for the ambient lighting analysis.

Please refer to FIG. 1 again. When step 120 ends and step 130 is entered, a second characteristic luminance value corresponding to the image is generated according to the plurality of luminance values respectively corresponding to the plurality of pixels of the plurality of blocks in the image. In this exemplary embodiment, the operation executed in step 130 is actually an average calculation upon the plurality of luminance values respectively corresponding to the plurality of pixels, and the second characteristic luminance value of the image can thereby be generated. Please note that the way of generating the second characteristic luminance value could also be performed after the block luminance values are generated; that is, the second characteristic luminance value could be generated by averaging all the block luminance values. Alternatively, it may be generated by directly averaging the plurality of luminance values of the plurality of pixels since the block luminance value is obtained by accumulating all pixels contained in the block. Both ways of generating the second characteristic luminance value are substantially equivalent. After step 120 and step 130 are completed, the first and the second characteristic luminance values are consequently generated. Then, step 140 is entered, utilizing a determining circuit to determine an ambient luminance value (namely the intensity of the static ambient lighting) according to the first and the second characteristic luminance values, wherein a maximum value among these two values is regarded as the ambient luminance value. However, in other embodiments, it may be possible that the ambient luminance value is obtained based on other algorithms performed upon the first and second characteristic luminance values. In other words, any method that obtains the ambient luminance value based on the first and the second characteristic luminance values should be considered as falling within the scope of the present invention. In the foregoing explanation, step 120*c* of this embodiment utilizes all block luminance values corresponding to the blocks that are configured as light/dark part blocks to perform the weighted average calculation to generate the first characteristic luminance value. However, in a preferred embodiment, the first characteristic luminance value is generated by the weighted average calculation upon the only block luminance values that correspond to the neighboring and contiguous light part blocks in the plurality of blocks and correspond to the neighboring and contiguous dark part blocks. In this way, the scattered light/dark part blocks in the image are not taken into account since these scattered blocks have only slight influences over the ambient lighting analysis. Omitting these scattered dark/light part blocks is helpful to reduce the computational overhead.

In the above description, the method of analyzing the ambient lighting in static surroundings is presented. A method of analyzing the ambient lighting under the condition that there exists a dynamic light source or object in the surroundings according to the second exemplary embodiment of the inventive image processing method will be explained in the following.

Figure 2:
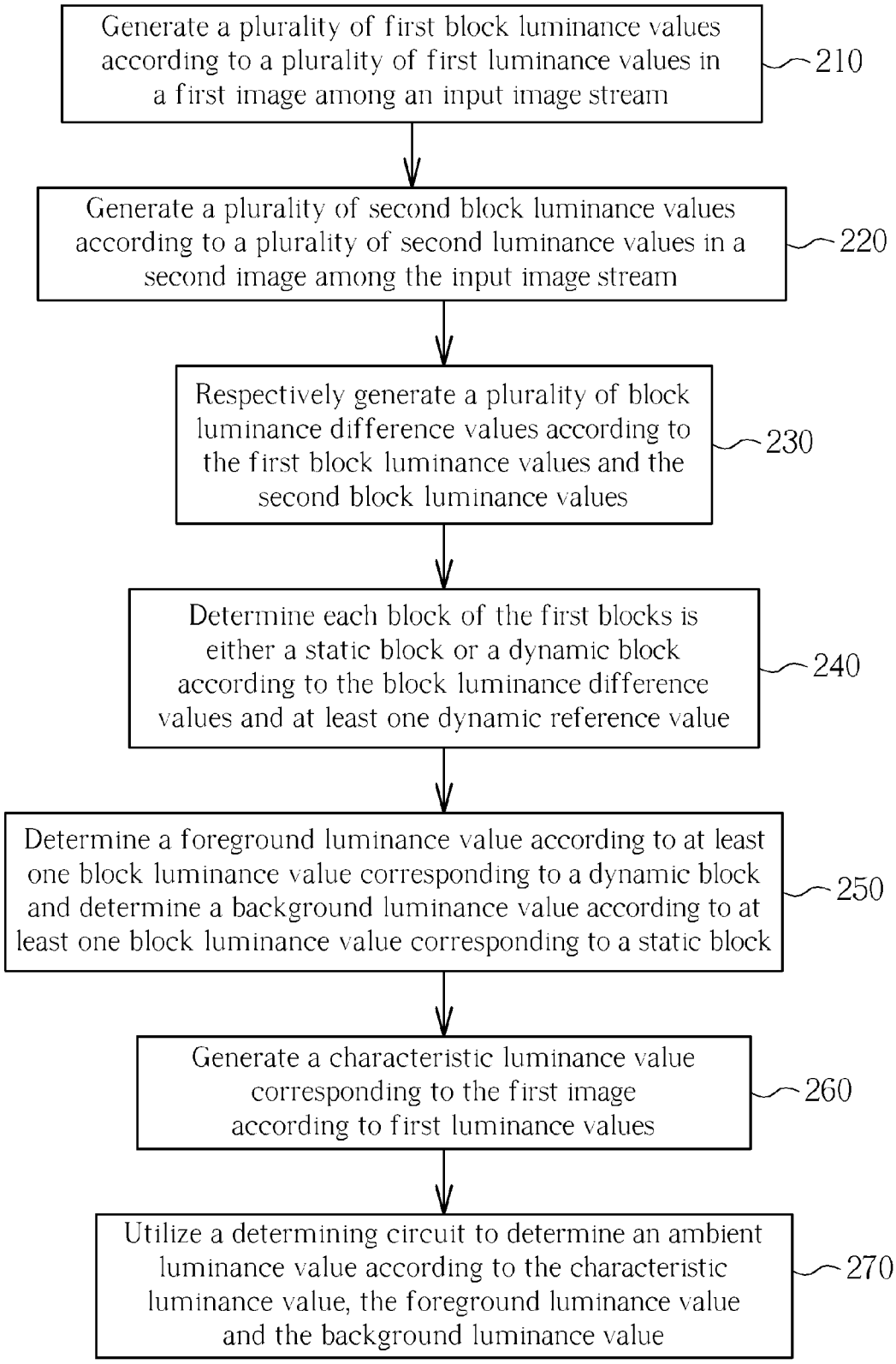
FIG. 2 is a flow chart representing a second exemplary embodiment of the inventive image processing method.

Please refer to FIG. 2, which depicts a flow chart of the second exemplary embodiment of the inventive image processing method. As shown in FIG. 2, the inventive image processing method includes:

Step 210: Generate a plurality of first block luminance values respectively corresponding to a plurality of first blocks of a first image among an input image stream according to a plurality of first luminance values respectively corresponding to a plurality of pixels in the plurality of first blocks;

Step 220: Generate a plurality of second block luminance values respectively corresponding to a plurality of second blocks of a second image among the input image stream according to a plurality of second luminance values respectively corresponding to a plurality of pixels in the plurality of second blocks;

Step 230: Respectively generate a plurality of block luminance difference values according to the plurality of first block luminance values and the plurality of second block luminance values;

Step 240: Determine each block of the plurality of first blocks is either a static block or a dynamic block according to the plurality of block luminance difference values and at least one dynamic reference value;

Step 250: Determine a foreground luminance value according to at least one block luminance value corresponding to a dynamic block and determine a background luminance value according to at least one block luminance value corresponding to a static block;

Step 260: Generate a characteristic luminance value corresponding to the first image according to the plurality of first luminance values; and Step 270: Utilize a determining circuit to determine an ambient luminance value according to the characteristic luminance value, the foreground luminance value and the background luminance value.

Since the second exemplary embodiment of the inventive image processing method intends to analyze the dynamic ambient lighting, the most important concept therein is to understand whether any dynamic light source or object exists in the surroundings. To render the dynamic light source/object detection for the surroundings, the analysis method checks whether the changing of pixel luminance values occurs in different images among the image stream. Therefore, the first and second steps (i.e. step 210 and 220) of this image processing method respectively calculate the plurality of block luminance values respectively corresponding to two different images that are chronological. Then, in step 230, a plurality of block luminance difference values corresponding to the plurality of block luminance values of two images are calculated by respectively subtracting a block luminance value of a first block in the first image from a block luminance value of a second block that is located at a position of the second image corresponding to the position of the first block. If the block luminance difference value of a certain block is not equal to zero, it means that dynamic light source/object probably exists in the certain block (which causes a dynamic condition). It should be noted that the first image processed in the step 210 and the second image processed in the step 220 are not necessarily exactly continuous in the input image stream. These two images only need to be chronological in the input image stream. After the plurality of block luminance difference values are generated, the operation executed in step 240 determines each block in the plurality of first blocks is either a static block or a dynamic block according to the plurality of block luminance difference values and at least one dynamic reference value. If a block has a luminance difference value that is greater than or equal to the dynamic reference value, the block is configured as the dynamic block while if a block has a block luminance difference value that is smaller than the dynamic reference value, the block is configured as the static block.

However, in a preferred exemplary embodiment of the present invention, a plurality of dynamic reference values are used to execute the dynamic/static block determination in step 240. In other words, depending on the plurality of different dynamic reference values, the plurality of first blocks may correspond to several different candidate determination results (namely, for determining the first block as a dynamic one or a static one). In this exemplary embodiment, the plurality of candidate determination results are utilized to determine a dynamic block determination result and a static block determination result. The dynamic block determination result and the static block determination result are utilized for selecting out the dynamic/static blocks in the step 240 in order for the following ambient light analysis. Thus, in this exemplary embodiment, according to the plurality of block luminance difference values and the plurality of different dynamic reference values, the plurality of candidate determination results are generated, respectively. Wherein, each of candidate determination results is based on a corresponding dynamic reference to configure each of the plurality of first blocks as a candidate dynamic block or a candidate static block. In the meantime, when a block luminance difference value regarding a block of the plurality of first blocks is greater than or equal to the corresponding dynamic reference value, the candidate determination result configures the block as a candidate dynamic block while when the block luminance difference value regarding the block of the plurality of first blocks is smaller than the corresponding dynamic reference value, the candidate determination result configures the block as a candidate static block.

Accordingly, the dynamic block determination result and the static block determination result are selected from the plurality of candidate determination results for the following process in the ambient light analysis. This selection is executed by referring to a plurality of averaged candidate dynamic block luminance values. Each averaged candidate dynamic block luminance value is generated by averaging neighboring and contiguous candidate dynamic blocks indicated in a corresponding candidate determination result. The dynamic block determination result should be a maximum averaged candidate dynamic block luminance value between all the averaged candidate dynamic block luminance values corresponding to the plurality of candidate block determination results. Thus, the selected dynamic block determination result can indicate dynamic blocks in step 240. Similarly, the static block determination result is also selected from the plurality of candidate determination results. This selection for the static block determination result is executed by referring to a plurality of averaged candidate static block luminance values. Each averaged candidate static block luminance value is generated by averaging neighboring and contiguous candidate static blocks indicated in a corresponding candidate determination result. The selected static block determination result should be a minimum averaged candidate static block luminance value between all the averaged static block luminance values corresponding to the plurality of candidate block determination results. Thus, the selected static block determination result can indicate static blocks in step 240

After the dynamic and static block determination results are respectively selected from the plurality of candidate determination results, the block luminance values of the dynamic and static blocks indicated by the dynamic and static block determination results are respectively utilized for calculating the foreground luminance value and the background luminance value. Thus, in step 250, the foreground luminance value is determined according to at least one block luminance value corresponding to a dynamic block and the background luminance value is determined according to at least one block luminance value corresponding to a static block. However, in a preferred exemplary embodiment, the foreground luminance value is further determined according to an averaged luminance value of all neighboring and contiguous dynamic blocks in the plurality of first blocks indicated by the dynamic block determination result. Similarly, the background luminance value is determined according to an averaged luminance value of all neighboring and contiguous static blocks in the plurality of first blocks indicated by the static block determination result. Please note that selecting the neighboring and contiguous dynamic/static blocks to calculate the foreground/background luminance value is not a limitation of the present invention, and is just a preferred implementation. Then, the plurality of luminance values of pixels is averaged to generate the characteristic luminance value in step 260. Consequently, in step 270, a maximum value is selected from the characteristic luminance value, the foreground luminance value and the background luminance value as the ambient luminance value by utilizing the determining circuit.

Figure 3:
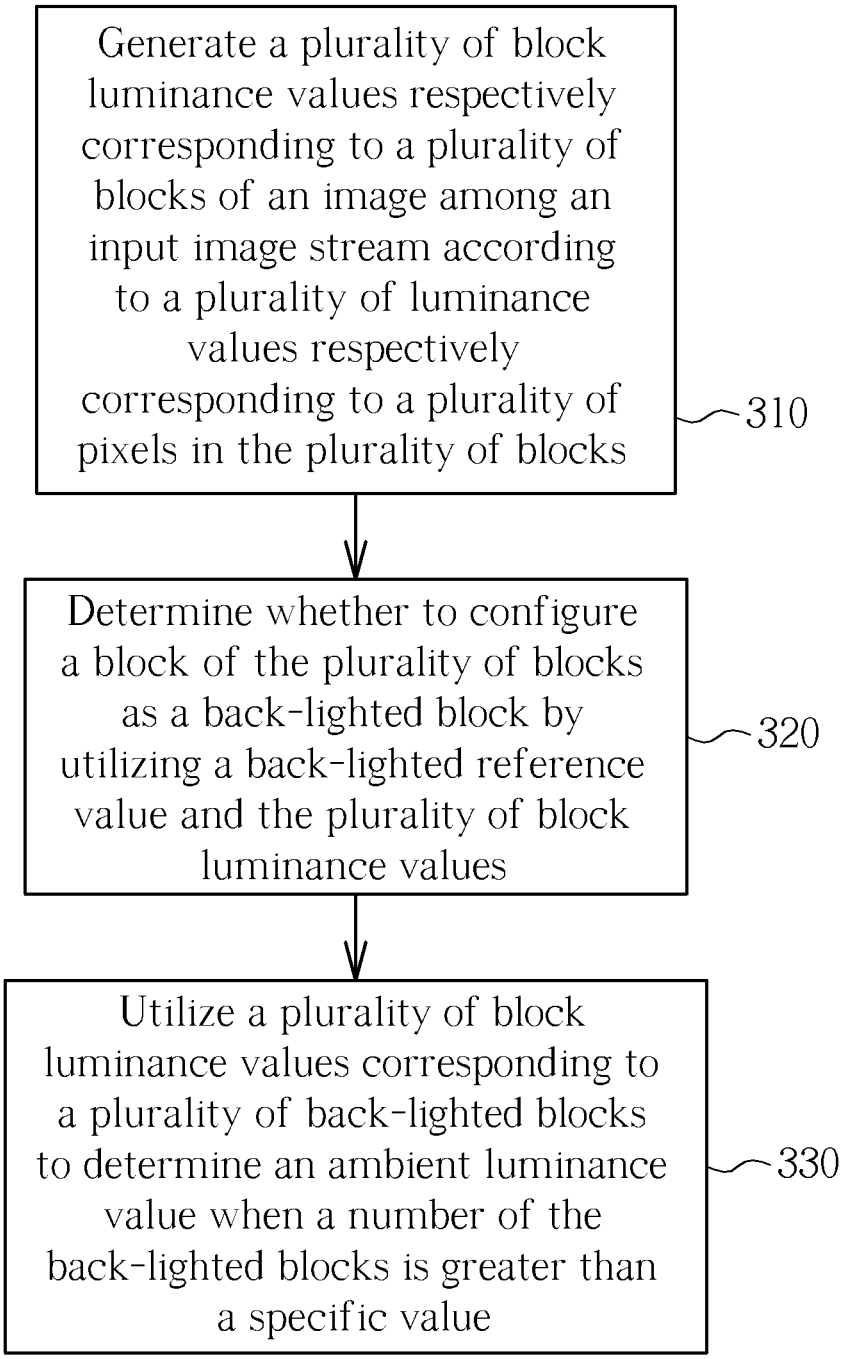
FIG. 3 is a flow chart representing a third exemplary embodiment of the inventive image processing method.

In a third exemplary embodiment of the inventive image processing method, a back-lighted image processing method which is applied under the condition that the light source in the surroundings is covered or sheltered is provided. Please refer to FIG. 3. This image processing method includes: step 310, which generates a plurality of block luminance values respectively corresponding to a plurality of blocks of an image among an input image stream according to a plurality of luminance values respectively corresponding to a plurality of pixels in the plurality of blocks; step 320, which determines whether to configure a block of the plurality of blocks as a back-lighted block by utilizing a back-lighted reference value and the plurality of block luminance values; and step 330, which utilizes a plurality of block luminance values corresponding to a plurality of back-lighted blocks to determine an ambient luminance value when a number of the back-lighted blocks is greater than a specific value.

In a preferred exemplary embodiment, the inventive image processing method additionally includes a method of adjusting original luminance values of pixels, which is used for correcting the influence on the actual pixel luminance value caused by the auto-exposure. As is well known to those skilled in the art, most image capturing devices have the auto-exposure function. Generally, the auto-exposure function can improve low light levels while capturing the image, providing a better image capturing quality. However, the auto-exposure function will cause the captured image to be unable to respond truly to the actual ambient lighting. Thus, it is necessary to provide a correction mechanism for correcting the discrepancy between the actual luminance value of the pixel and the captured luminance value of the pixel provided by the image capturing device having the auto-exposure function.

An original luminance adjustment operation is therefore further introduced in the invention. The original luminance adjustment operation respectively adjusts a plurality of original luminance values (directly derived from the image capturing device) respectively corresponding to the plurality of pixels of the image according to the exposure of the image to generate the plurality of luminance values to be analyzed, removing the influence caused by the auto-exposure function. This operation individually processes the plurality of original luminance values corresponding to all the pixels in the image. The original luminance value adjustment operation executed for a pixel includes steps: (a) multiplying a weighting value corresponding to the pixel by a difference value between an exposure value corresponding to the image and an exposure reference to generate a multiplication result; and (b) adding the multiplication result to an original luminance value corresponding to the pixel to generate a luminance value corresponding to the pixel. In step (a) of the original luminance value adjustment operation, the exposure value adopted by the auto-exposure function and the exposure reference are utilized to generate the difference value by subtraction, wherein the exposure reference may be changed according to different requirements. Then, the weighting value is determined according to the position in which the pixel is located in the image, wherein pixels in different positions in the image may correspond to different weighting values since pixels in the different positions of the same image may be inconsistently exposed. For responding to this phenomenon, the difference value is multiplied by the weighting value to generate a multiplication result. In the step (b), the multiplication result is added to the original luminance value corresponding to the pixel. As result, by the original luminance value adjustment, the luminance value which is irrelevant to the exposure value of the auto-exposure function can be obtained and utilized in the following analysis process.

Furthermore, in addition to ambient lighting analysis, another objective of the present invention is to determine a hardware control value according to the obtained ambient luminance value, wherein the hardware may be the backlight source of the keyboard or the backlight source of the LCD monitor. The hardware control value based on the ambient luminance value is utilized to determine how to control the hardware. For example, when the ambient luminance value determined by the inventive image processing method shows that the ambient light is bright, the hardware control value will determine to have the hardware turned off; otherwise, the hardware control value will determine to have the hardware turned on while the ambient light is dark. However, the types of hardware the present invention can be applied to are not limited, and the above-mentioned cases are just for illustrative purposes.

The main concept of how to generate the hardware control value is to prevent the generated hardware control value from being influenced by the transient of ambient lighting. In other words, the concept of the inventive hardware control intends to eliminate excessively frequent state switching (on/off) of the hardware due to the transient of ambient lighting, for example, the backlight source of the keyboard may be turned on and off too frequently as the ambient lighting suddenly changes. Thus, the present invention further introduces a step increasing control mechanism to maintain the stability of the hardware control.

In a preferred exemplary embodiment, the step increasing control operation includes steps: (a') subtracting the ambient luminance value from a previous step increasing control result derived according to the input image stream to generate a subtraction result; (b') performing a clamping operation upon the subtraction result according to a first set of thresholds to generate a first output result; (c') adding the first output result to the previous step increasing control result to generate an addition result; and (d') performing a clamping operation according to the addition result and a second set of thresholds to generate a current step increasing control result. Detailed descriptions regarding each step are given below. At first, assuming that the above-mentioned ambient luminance value is an integer ranging from 0 to 255, the ambient luminance value is subtracted from a previous step increasing control result (which is derived according to an ambient luminance value analyzed from an earlier image among the input image stream, also having the value ranging from 0 to 255) in step (a') to generate a subtraction result. Then, in step (b'), the subtraction result is processed by a first clamping operation according to a first set of thresholds (+1, −1) to generate a first output result. More specifically, if the subtraction result of the ambient luminance value and the previous step increasing control result is greater than +1, the first clamping operation outputs the first output result of 1. If the subtraction result of the ambient luminance value and the previous step increasing control result is smaller than −1, the first clamping operation outputs the first output result of −1. If the subtraction result is between +1 and −1, the first clamping operation directly outputs the subtraction result as the first output result. Hence, in step (b'), it can be determined that the current ambient luminance value is either close to or far away from the previous ambient luminance level (that is, the previous step increasing control result).

By means of the subtraction, the changing of the ambient luminance value is prevented from excessively influencing the hardware control value so that the hardware under control does not alter its operating state too frequently. In step (c'), the first output result is added into the previous step increasing control result to generate an addition result. Then, in step (d'), a second clamping operation is performed upon the addition result according to the second set of thresholds (100, 50) to generate the current step increasing control result. Similarly, if the addition result is greater than 100, the second clamping operation outputs the current step increasing control result having the value of 100. If the addition result is smaller than 50, the second clamping operation outputs the current step increasing control result having the value of 50. If the addition result is between 100 and 50, the second clamping operation directly outputs the addition result as the current step increasing control result. Finally, the current step increasing control result is utilized for controlling the operating state of the hardware such as the backlight source of the keyboard or the backlight source of the LCD monitor.

The current step increasing control result is used as a reference for controlling hardware. For hardware under such a step increasing control, if the hardware receives a current step increasing control result having the value of 100, it represents that it the current surroundings are bright, and the operation state of the hardware may be changed along with the current step increasing control result for the bright ambient light. Similarly, if the hardware receives a current step increasing control result having the value of 50, it represents that it the current surroundings are dark and the operation state of the hardware may be changed for the dark ambient light accordingly. By properly configuring the second set of thresholds (e.g. (100, 50)), the hardware under the step increasing control can change its operating state steadily and properly without frequent switching. The configuration of the first set of thresholds (e.g. (−1, +1)) involves how fast the step increasing control responds to the changing of the ambient lighting (i.e. from dark to bright and vice versa). For example, when the first set of threshold values is configured as (−2,+2), such an increment (namely 2) causes the current step increasing control result to approach the second set of thresholds of (100, 50) more rapidly; that is, the step increasing control will be more sensitive to the changing of the ambient lighting. Please note that the threshold values set forth above are just for illustrative purposes, and are not meant to be a limitation of the present invention. In addition, all or some of the exemplary embodiment of the inventive image processing method may be incorporated, in other exemplary embodiments of the inventive image processing method. For example, an exemplary embodiment of the inventive image processing method may be capable of performing ambient lighting analysis both under the dynamic and the static conditions. Such an exemplary embodiment will be illustrated later in conjunction with the inventive image processing device.

Figure 4:
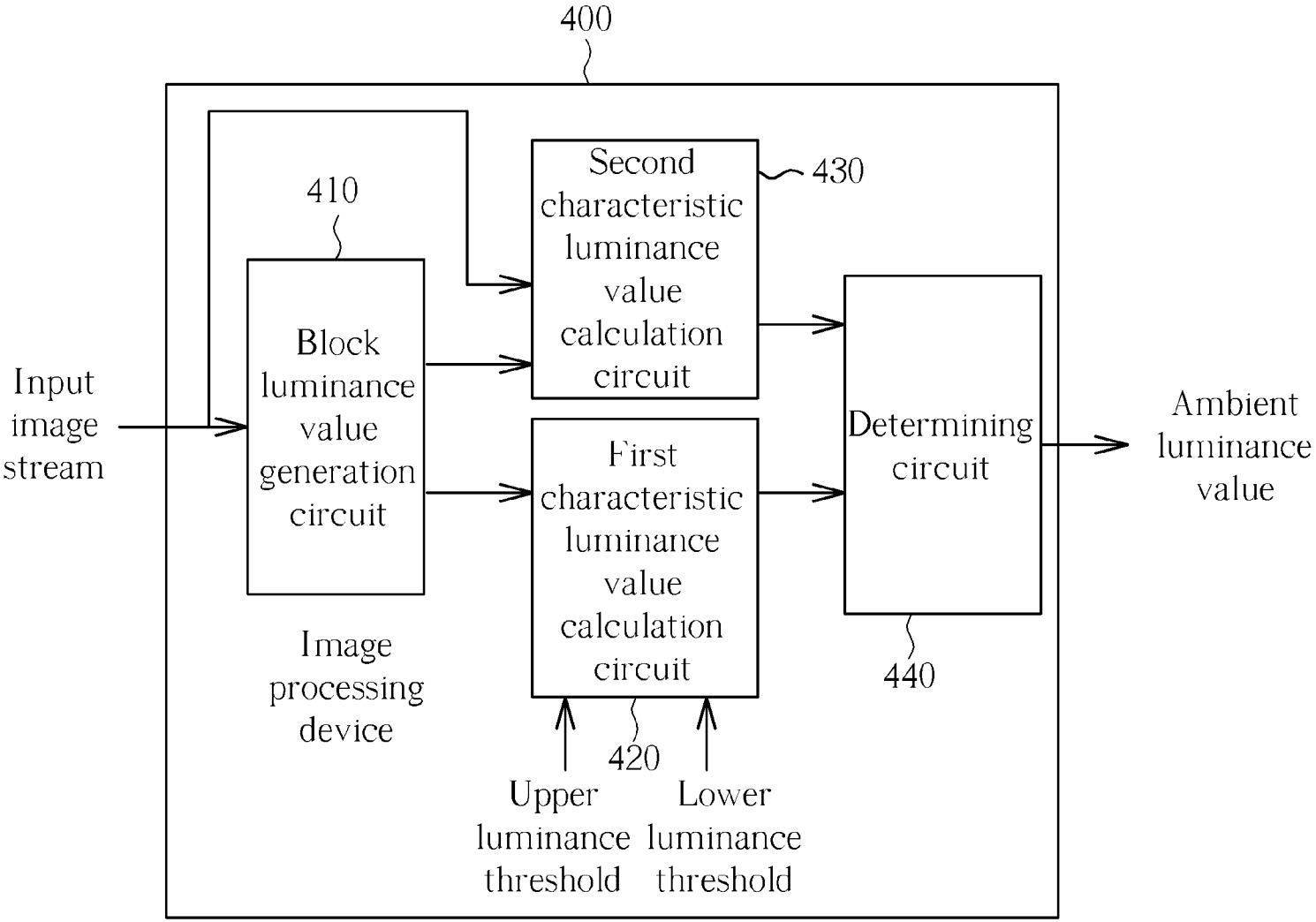
FIG. 4 is a block diagram representing a first exemplary embodiment of the inventive image processing device.

Please refer to FIG. 4, which depicts a block diagram of a first exemplary embodiment of the inventive image processing device. The image processing device 400 as shown in FIG. 4 is utilized for performing the ambient lighting analysis upon the condition that there is no dynamic light source or object in the surroundings. The image processing device 400 includes (but is not limited to): a block luminance value generation circuit 410, a first characteristic luminance value calculation circuit 420, a second characteristic luminance value calculation circuit 430 and a determining circuit 440. As the image processing device 400 is designed based on the concept of the first exemplary embodiment of the inventive image processing method, the detailed operations and functions of the circuit components in the image processing device 400 can be understood by referring to the description pertinent to the first exemplary embodiment of the inventive image processing method. Only the summary description of the image processing device 400 is provided in the following. The block luminance value generation circuit 410 is utilized for generating a plurality of block luminance values respectively corresponding to a plurality of blocks of an image among an input image stream according to a plurality of luminance values respectively corresponding to a plurality of pixels in the plurality of blocks. The first characteristic luminance value calculation circuit 420 is coupled to the block luminance value generating circuit 410 and utilized for determining a first characteristic luminance value corresponding to the image according to a relationship between the plurality of block luminance values and an upper luminance threshold, and a relationship between the plurality of block luminance values and a lower luminance threshold. The second characteristic luminance value calculation circuit 430 is utilized for determining a second characteristic luminance value corresponding to the image according to the plurality of luminance values respectively corresponding to the plurality of pixels of the plurality blocks of the image. The determining circuit 440 is coupled to the first characteristic luminance value calculation circuit 420 and the second characteristic luminance value calculation circuit 430, and utilized for determining an ambient luminance value according to the first and second characteristic luminance values. Please note that, as the second characteristic luminance value is obtained by averaging all the luminance values of all pixels in the image, the second characteristic luminance value calculation circuit 430 may directly receive the image from the input image stream, thereby performing an average calculation according to each luminance value of the pixels to determine the second characteristic luminance value. Alternatively, the second characteristic luminance value calculation circuit 430 may perform the average calculation upon the plurality block luminance values generated from the block luminance value generation circuit 410 to determine the second characteristic luminance value. Both of the above cases fall within the scope of the present invention.

Figure 5:
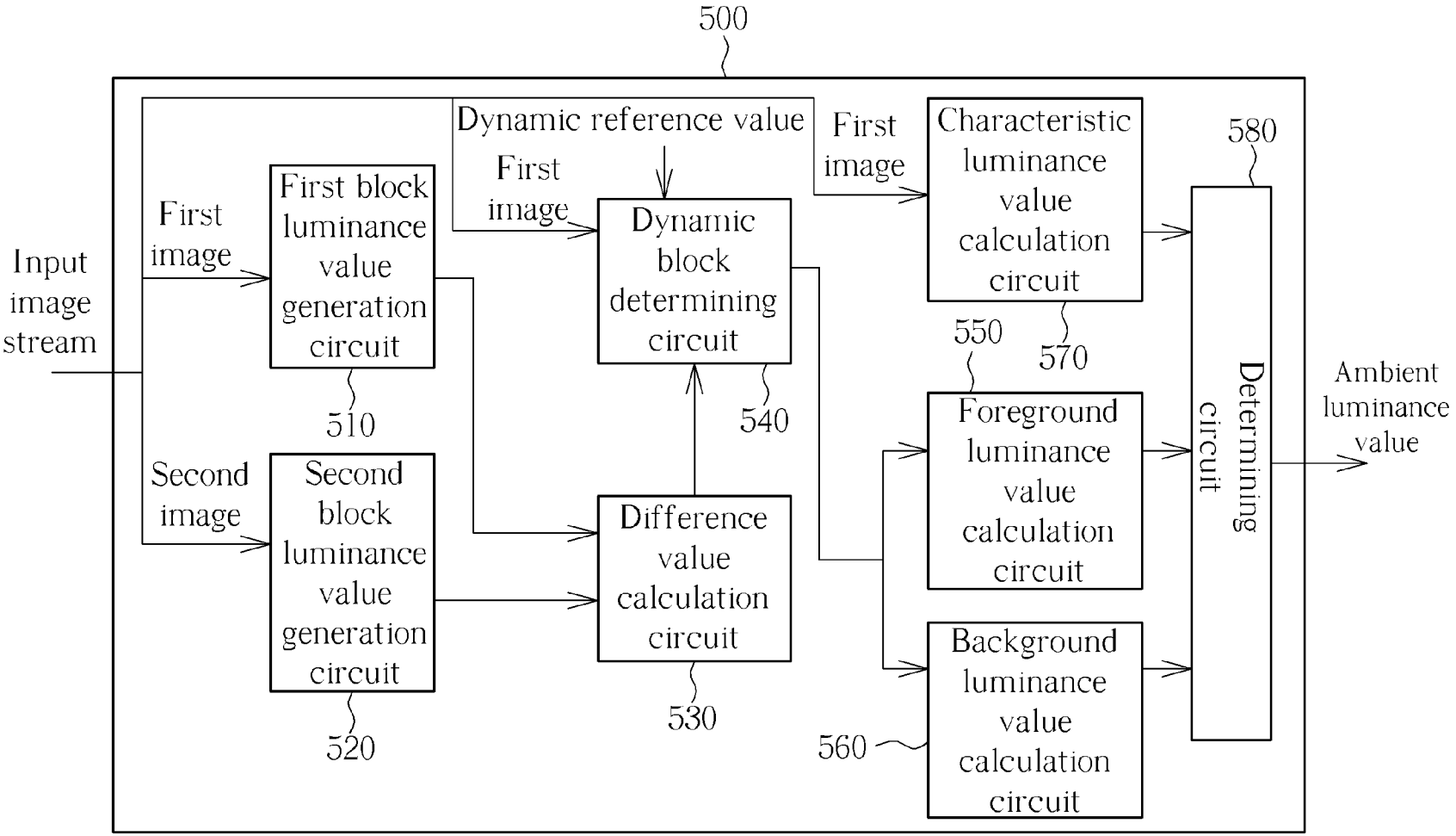
FIG. 5 is a block diagram representing a second exemplary embodiment of the inventive image processing device.

A second exemplary embodiment of the inventive image processing device based on the second exemplary embodiment of the inventive image processing method is introduced as follows. Please refer to FIG. 5, which depicts a block diagram of a second exemplary embodiment of the inventive image processing device. The image processing device 500 as shown in FIG. 5 is utilized for performing an ambient lighting analysis upon the condition that there is a dynamic light source or object in the surroundings. The image processing device 500 includes (but is not limited to): a first block luminance value generation circuit 510, a second block luminance value generation circuit 520, a difference value calculation circuit 530, a dynamic block determining circuit 540, a foreground luminance value calculation circuit 550, a background luminance value calculation circuit 560, a characteristic luminance value calculation circuit 570 and a determining circuit 580.

The first block luminance value generation circuit 510 is utilized for generating a plurality of first block luminance values respectively corresponding to a plurality of first blocks of a first image among an input image stream according to a plurality of first luminance values respectively corresponding to a plurality of pixels in the plurality of first blocks. The second block luminance value generation circuit 520 is utilized for generating a plurality of second block luminance values respectively corresponding to a plurality of second blocks of a second image among an input image stream according to a plurality of second luminance values respectively corresponding to a plurality of pixels in the plurality of second blocks. The difference value calculation circuit 530 is coupled to the first block luminance value generation circuit 510 and the second block luminance value generation circuit 520, and utilized for respectively generating a plurality of block luminance difference values according to the plurality of first block luminance values and the plurality of second block luminance values. The dynamic block determining circuit 540 is coupled to the difference value calculation circuit 530, and utilized for determining each block of the plurality of first blocks is either a static block or a dynamic block according to the plurality of block luminance difference values and at least one dynamic reference value. Also, the dynamic block determining circuit 540 is utilized for temporarily storing candidate determination results and each first block luminance value. The foreground luminance value calculation circuit 550 is coupled to the dynamic block determining circuit 540, and utilized for determining a foreground luminance value according to at least one block luminance value corresponding to a dynamic block. The background luminance value calculation circuit 560 is coupled to the dynamic block determining circuit 540, and utilized for determining a background luminance value according to at least one block luminance value corresponding to a static block. The characteristic luminance value calculation circuit 570 is utilized for generating a characteristic luminance value corresponding to the first image according to the plurality of first luminance values. The determining circuit 580 is coupled to the foreground luminance value calculation circuit 550, the background luminance value calculation circuit 560 and the characteristic luminance value calculation circuit 570, and utilized for determining an ambient luminance value according to the characteristic luminance value, the foreground luminance value and the background luminance value. As the above-mentioned image processing device 500 is designed based on the concept of the second exemplary embodiment of the inventive image processing method, the detailed descriptions of the function and operation of each circuit component in the image processing device 500 are omitted here.

Figure 6:
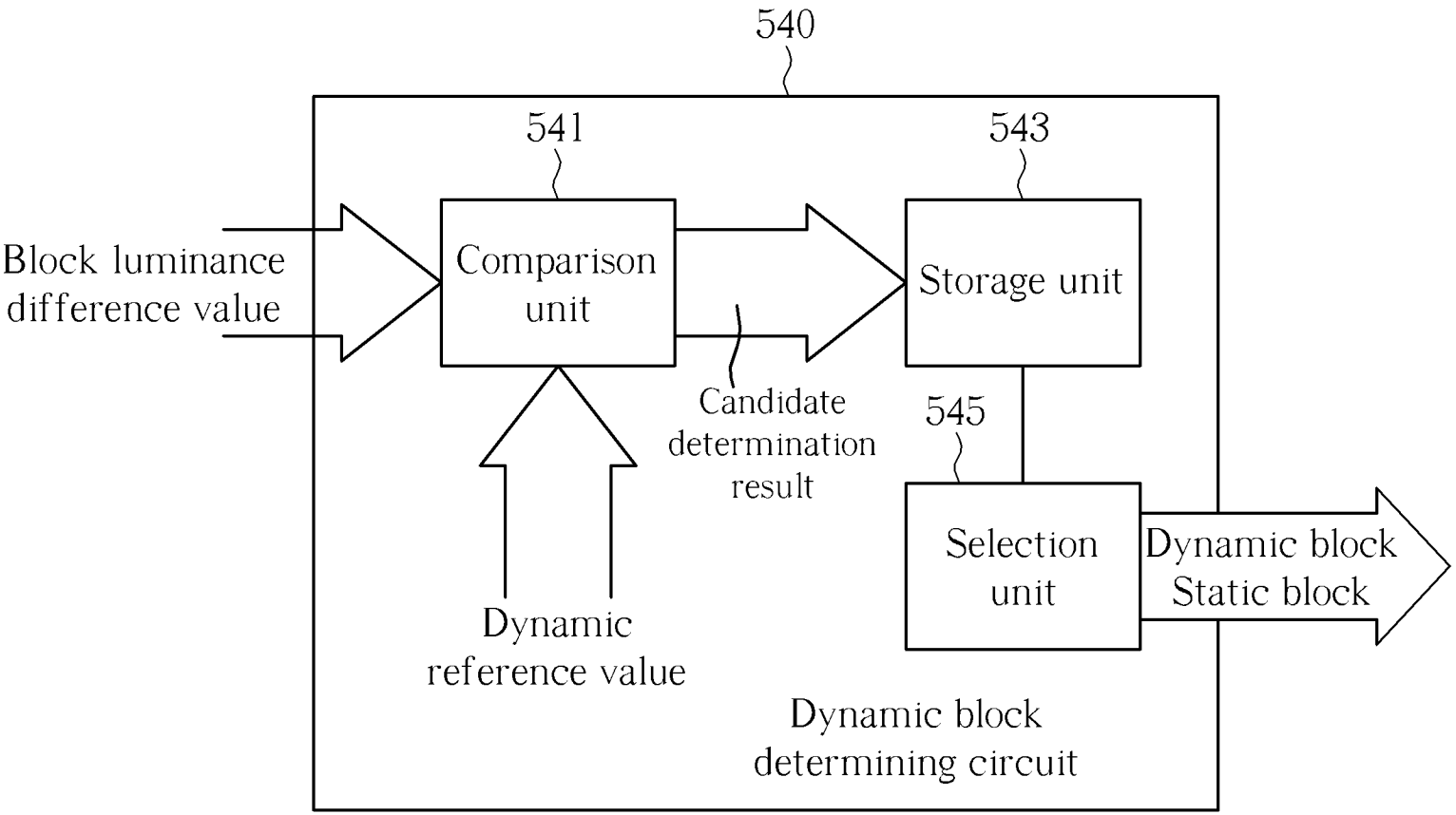
FIG. 6 is a detailed block diagram of the dynamic block determination circuit shown in FIG. 5.

In a preferred exemplary embodiment, the dynamic block determining circuit 540 utilizes a plurality of dynamic reference values to perform the foregoing dynamic/static block determination. Thus, due to these different dynamic reference values, a plurality of different candidate determination results will be generated. Then, the plurality of candidate determination results are utilized for determining a dynamic block determination result and a static block determination result. The dynamic/static blocks of the plurality of blocks will be selected based on the dynamic block determination result and the static block determination result. Accordingly the selected dynamic/static blocks will be utilized in the following analysis. FIG. 6 depicts a detailed block diagram of the dynamic block determining circuit 540 as shown in FIG. 5 according to the preferred exemplary embodiment of the present invention. As shown in FIG. 6, the dynamic block determining circuit 540 includes (but is not limited to): a comparison unit 541, a storage unit 543, and a selection unit 545. The comparison unit 541 compares the plurality of block luminance difference values with the plurality of different dynamic reference values to generate a plurality of candidate determination results. Candidate determination results are actually different dynamic/static block determination result combinations. The storage unit 543 stores the plurality of candidate determination results, and the selection unit 545 selects a dynamic block determination result and a static block determination result from candidate determination results. The selection unit 545 further configures each first block to be either a static block or a dynamic block according to the dynamic block determination result and the static block determination result. In this, the storage unit 543 may store each block luminance value of a first block. Thus, once the following foreground luminance value calculation unit 550 and background luminance value calculation unit 560 get the information of the selected dynamic/static block determination results from the selection unit 545, the foreground luminance value calculation unit 550 and background luminance value calculation unit 560 can accordingly obtain the corresponding dynamic block luminance values and the corresponding static block luminance values from storage unit 543 to calculate the foreground luminance value and the background luminance value. Furthermore, the manner of how the selection unit 545 selects the dynamic block determination result and the static block determination result from the plurality of candidate block determination results is already explained in the foregoing descriptions, and therefore the detailed description regarding the selection manner is omitted here for the sake of brevity.

Figure 7:
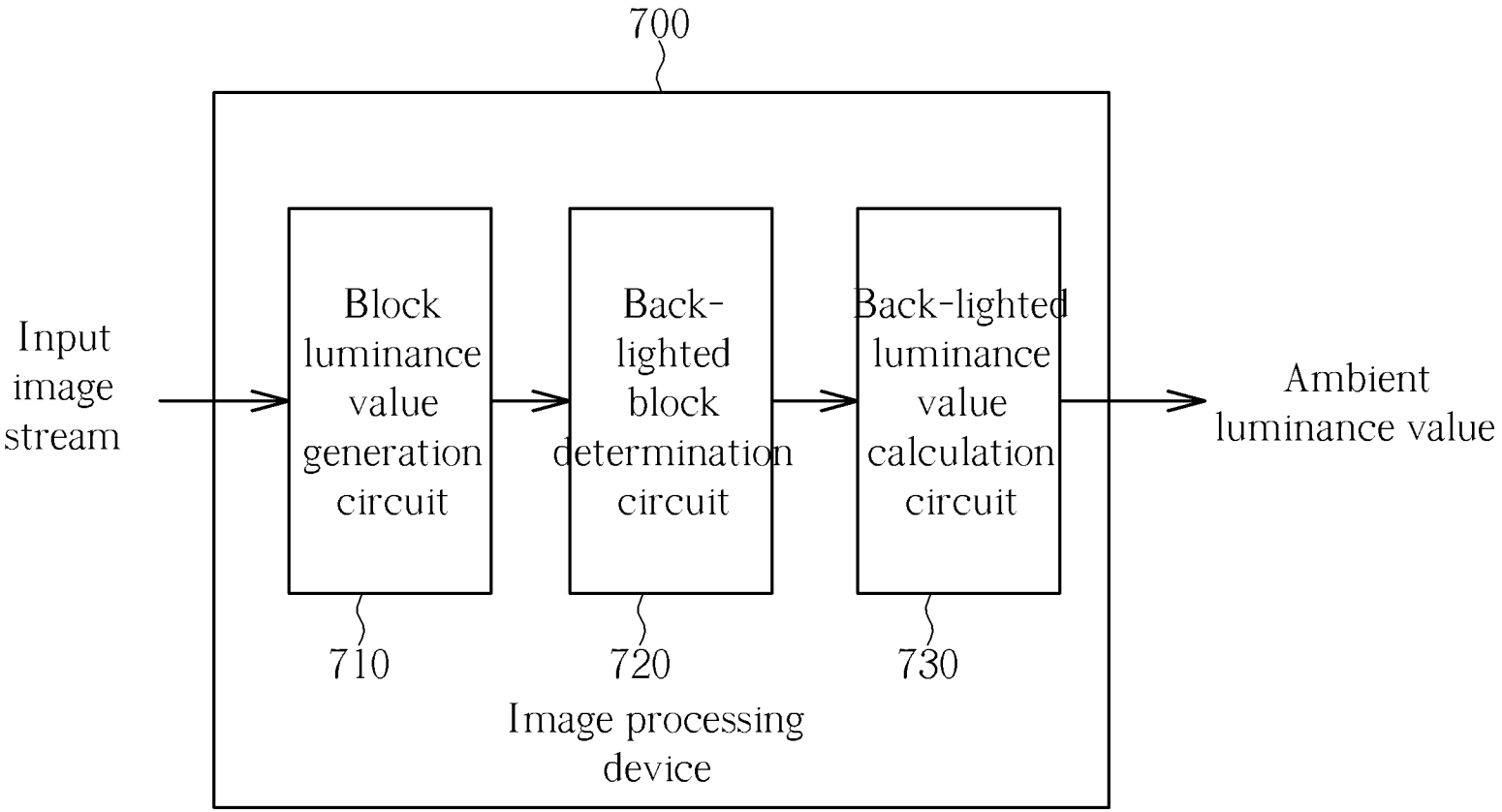
FIG. 7 is a block diagram representing a third exemplary embodiment of the inventive image processing device.

A third exemplary embodiment of the inventive image processing device which is applied in a back-lighted condition and is designed based on the third exemplary embodiment of the inventive image processing method as set forth above will be provided as follows. Please refer to FIG. 7, which is a block diagram of the third exemplary embodiment of the inventive image processing device. As shown in FIG. 7, the image processing device 700 includes (but is not limited to): a block luminance value generation circuit 710, a back-lighted block determination circuit 720 and a back-lighted luminance value calculation circuit 730. The image processing device 700 is mainly applied under the condition that the light source in the surroundings is covered. That is, the image processing device 700 is used for performing the back-lighted ambient lighting analysis. In detail, the block luminance value generation circuit 710 is utilized for generating a plurality of block luminance values respectively corresponding to a plurality of blocks of an image among an input image stream according to a plurality of luminance values respectively corresponding to a plurality of pixels in the plurality of blocks. The back-lighted block determining circuit 720 is coupled to the block luminance value generation circuit 710, and utilized for determining whether to configure a block of the plurality of blocks as a back-lighted block by utilizing a back-lighted reference value and the plurality of block luminance values. The back-lighted luminance value calculation circuit 730 is coupled to the block luminance value generation circuit 710 and the back-lighted block determining circuit 720, and used for utilizing a plurality of block luminance values corresponding to a plurality of back-lighted blocks to determine an ambient luminance value when a number of back-lighted blocks is greater than a specific value. In a preferred exemplary embodiment, the back-lighted luminance value calculation circuit 730 averages all the plurality of block luminance values corresponding to the back-lighted block to determine the ambient luminance value.

Figure 8:
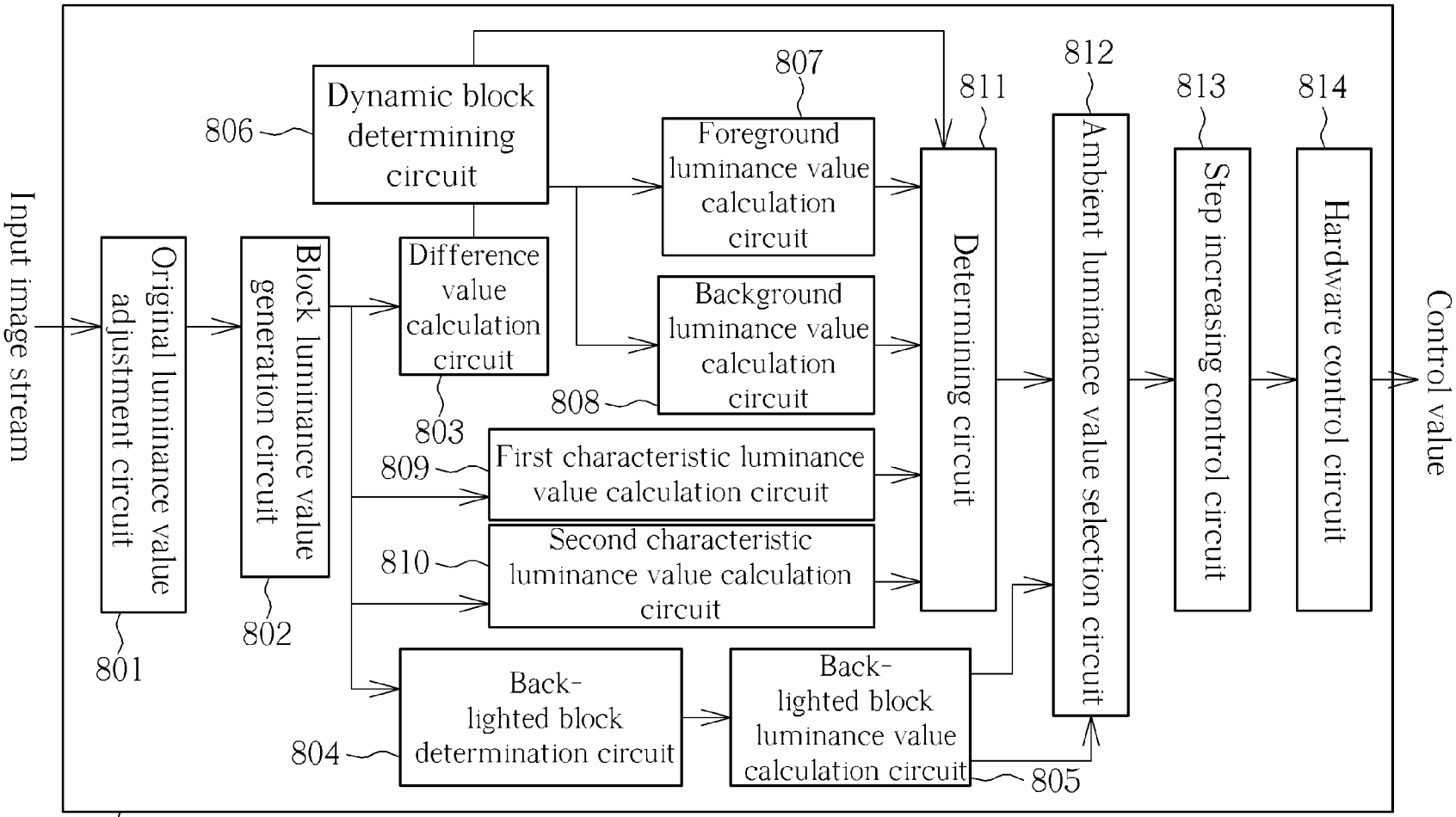
FIG. 8 is a block diagram representing a fourth exemplary embodiment of the inventive image processing device.

Although the above-mentioned exemplary embodiments of the inventive image processing device are individually applied under the static condition, the dynamic condition, and the back-lighted condition, another exemplary embodiment may be applied under all the possible conditions. That is, the present invention also provides an image processing method and device that can perform the ambient lighting analysis for more than one condition. Hence, a fourth exemplary embodiment of the inventive image processing device capable of performing ambient lighting analysis under the static condition, the dynamic condition and the back-lighted condition is introduced as follow. Please refer to FIG. 8, which depicts a fourth exemplary embodiment of the inventive image processing device. As shown in FIG. 8, an image processing device 800 includes (but is not limited to): an original luminance value adjustment circuit 801, a block luminance value generation circuit 802, a difference value calculation circuit 803, a back-lighted block determination circuit 804, a back-lighted luminance value calculation circuit 805, a dynamic block determination circuit 806, a foreground luminance value calculation circuit 807, a background luminance value calculation circuit 808, a first characteristic luminance value calculation circuit 809, a second characteristic luminance value calculation circuit 810, a determining circuit 811, an ambient luminance value selection circuit 812, a step increasing control circuit 813 and a hardware control circuit 814. As the functions and operations of most circuits in the image processing device 800 are already explained above, the descriptions are omitted here for the sake of brevity.

At first, in this exemplary embodiment, images among the image stream are sent to the original luminance value adjustment circuit 801 and pixel luminance values therefore adjusted, and the original luminance value adjustment circuit 801 accordingly outputs each luminance value of each pixel to the block luminance value generation circuit 802. The block luminance value generation circuit 802 respectively generates the plurality of block luminance values corresponding to different images to the difference value calculation circuit 803, the first characteristic luminance value calculation circuit 809, the second characteristic luminance value calculation circuit 810 and the back-lighted block determination circuit 804. For the difference value calculation circuit 803, the block luminance value generation circuit 802 outputs the plurality of block luminance values respectively corresponding to two different images among the image stream to the difference value calculation circuit 803 in order to generate a plurality of block luminance difference values. For the first characteristic luminance value calculation circuit 809, the block luminance value generation circuit 802 only outputs a plurality of block luminance values corresponding to a single image.

After the foreground luminance value calculation circuit 807, the background luminance value calculation circuit 808, the first characteristic luminance value calculation circuit 809 and the second characteristic luminance value calculation circuit 810 respectively calculate different luminance values and characteristic luminance values, and the determining circuit 811 determines which value of the above luminance values is to be outputted depending on whether a dynamic light source or object exists in the surroundings. Hence, the dynamic block determining circuit 806 is also coupled to the determining circuit 811 so that the determining circuit 811 can hereby determine whether a dynamic light source or a dynamic object exists in the surroundings according to the dynamic block determination result. As long as the dynamic light source or the dynamic object exists in the surroundings, the determining circuit 811 selects a maximum value from the foreground luminance value, the background luminance value, and the second characteristic luminance value (which is derived by directly averaging the luminance values of all the pixels) to be output; otherwise, the determining circuit 811 selects a maximum value from the first characteristic luminance value and the second characteristic luminance value to be output. Accordingly, the ambient luminance value selection circuit 812 (which may be simply implemented with a multiplexer) selects one of the output values of the determining circuit 811 and the back-lighted luminance value calculation circuit 805 as the ambient luminance value, wherein the selection is based on the number of possible back-lighted blocks. In detail, if the number of blocks that are determined as back-lighted blocks in the image is greater than a specific value, the ambient luminance value selection circuit 812 selects the output value of the back-lighted luminance value calculation circuit 805 as the ambient luminance value; otherwise, the ambient luminance value selection circuit 812 selects the output value of the determining circuit 811 as the ambient luminance value. Then, the ambient luminance value outputted from the ambient luminance value selection circuit 812 is sent to the step increasing control circuit 813, and the step increasing control circuit 813 generates and outputs a current step increasing control result to the hardware control circuit 814. Finally, the hardware control circuit 814 provides a hardware control value according to the received current step increasing control result. In a general case, when the control value generated by the hardware control circuit 814 is utilized for controlling a backlight source of a keyboard, the control value may be logic "0" or logic "1", turning on/off the backlight source of the keyboard.

Figure 9:
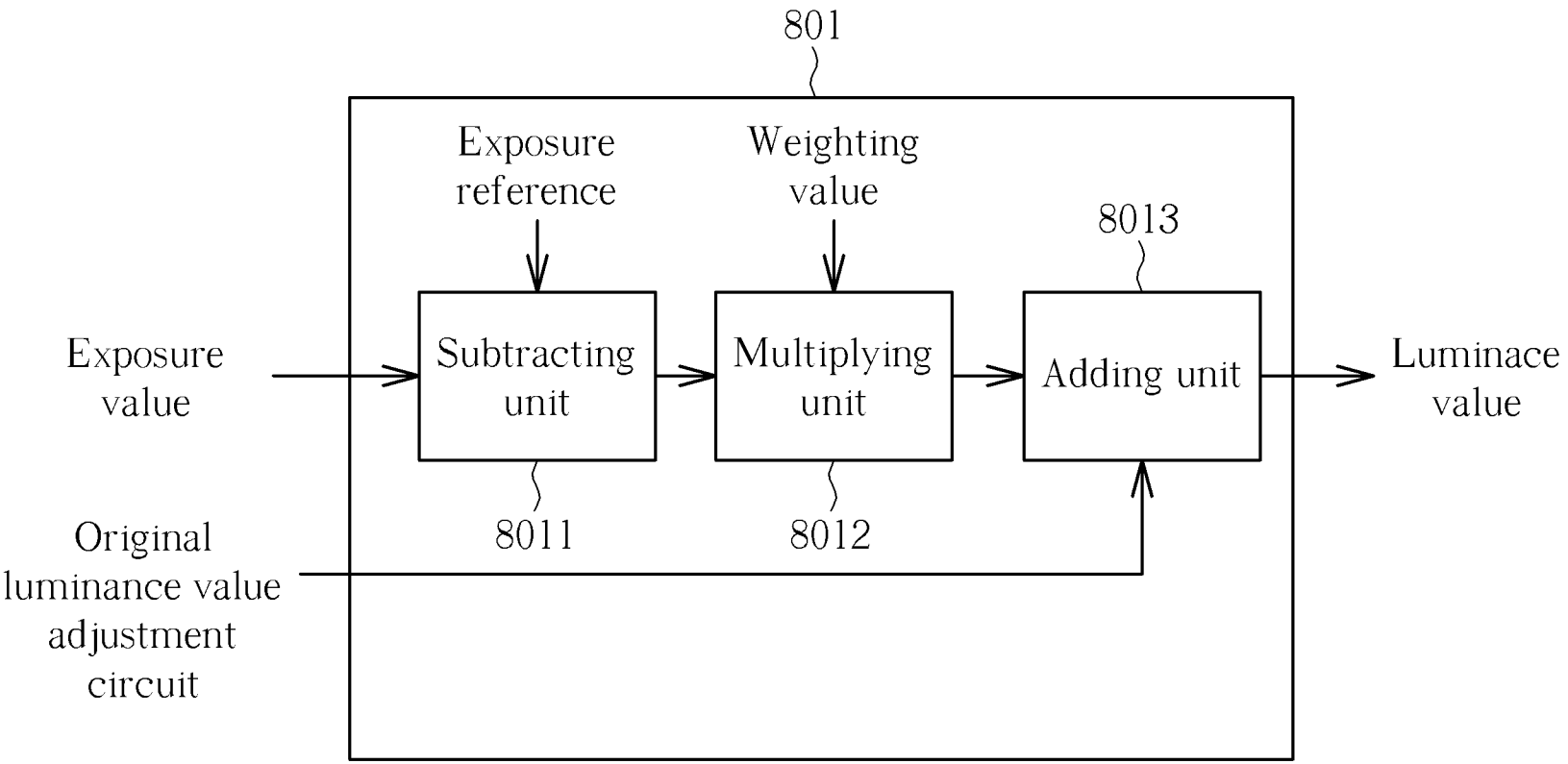
FIG. 9 is a detailed block diagram of the original luminance value adjustment circuit shown in FIG. 8.

As described before, in order to eliminate the influence of auto-exposure from the ambient lighting analysis, the image processing device 800 utilizes the original luminance value adjustment circuit 801 illustrated in FIG. 9. As shown in FIG. 9, the original luminance value adjustment circuit 801 includes (but is not limited to): a subtracting unit 8011, a multiplying unit 8012 and an adding unit 8013, wherein both the subtracting unit 8011 and the adding unit 8013 may be rendered by means of adders. The original luminance value adjustment circuit 801 individually adjusts an original luminance value (outputted by the image capturing device) corresponding to each pixel. The subtracting unit 8011 is utilized for generating a difference value between an exposure value corresponding to the first image and an exposure reference. The multiplying unit 8012 is coupled to the subtracting unit 8011, and multiplies the difference value by a weighting value corresponding to the pixel to generate a multiplication result. The adding unit 8013 is coupled to the multiplying unit 8012, and adds the multiplication result to the original luminance value corresponding to the pixel to generate a luminance value corresponding to the pixel.

As a result, even when the auto-exposure function of the web-camera is enabled, the discrepancy between the actual luminance value and the luminance value captured by the web-camera can be corrected by means of the original luminance value adjustment circuit 801. Furthermore, the original luminance value adjustment circuit 801 can also be adopted in other exemplary embodiments of the inventive image processing device. For example, the original luminance value adjustment circuit 801 may be disposed prior to the first/second block luminance value generation circuit 510/520 as shown in FIG. 5. to receive the input image stream and derive the luminance value according to the original luminance value by the above-mentioned process, thereby outputting the luminance value of each pixel to the first/second block luminance value generation circuit.

Figure 10:
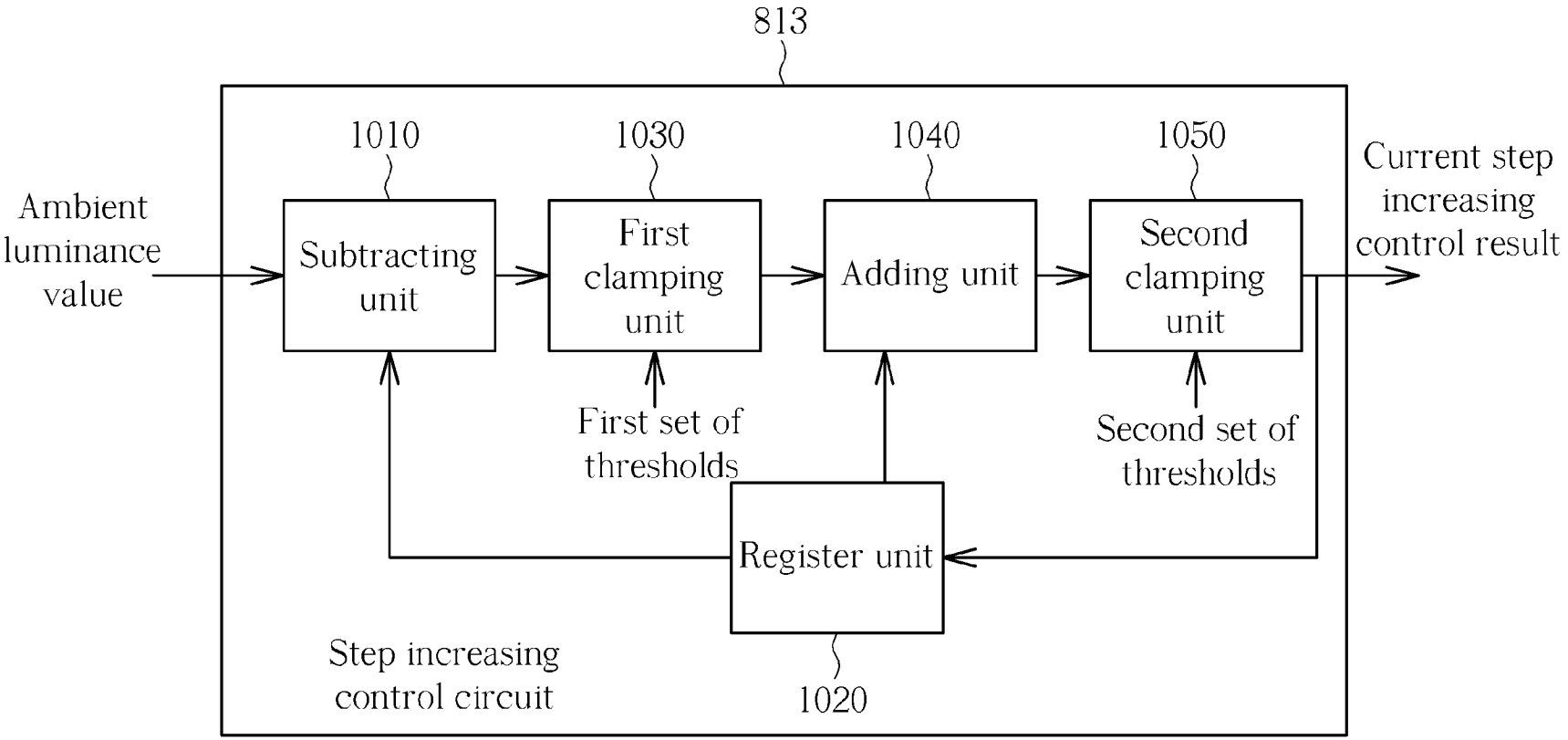
FIG. 10 is a detailed block diagram of the step increasing control circuit shown in FIG. 8.

A detailed block diagram of the step increasing control circuit 813 is shown in FIG. 10 and briefly explained as follow. The step increasing control circuit 813 includes (but is not limited to): a subtracting unit 1010, a register unit 1020, a first clamping unit 1030, an adding unit 1040, and a second clamping unit 1050. The step increasing control unit 813 is mainly utilized for generating a current step increasing control result according to the ambient luminance value. The register unit 1020 is coupled to the second clamping unit 1050, and is utilized for temporarily storing a previous step increasing control result which is generated according to the input image stream. The subtracting unit 1010 is coupled to the ambient luminance value selection circuit 812 and the register unit 1020, and utilized for generating a subtraction result according to the ambient luminance value and the previous step increasing control result. The first clamping unit 1030 is coupled to the subtracting unit 110, and utilized for performing a clamping operation according to the subtraction result and a first set of threshold values to generate a first output result. The adding unit 1040 is coupled to the register unit 1020 and the first clamping unit 1030, and utilized for adding the first output result to the previous step increasing control result to generate an addition result. The second clamping unit 1050 is coupled to the adding unit 1040 and the register unit 1020, for performing a clamping operation according to the addition result and a second set of threshold values to generate the current step increasing control result. Please note that, although in this exemplary embodiment the subtracting unit 1010 is coupled to the ambient luminance value selection unit 812, the subtracting unit 1010 may be merely coupled to a determining circuit to receive the ambient luminance value in other exemplary embodiments that do not need the ambient luminance selection circuit 812.

Reference in the specification to "one exemplary embodiment" or "one preferred exemplary embodiment" means that a particular feature, structure, or characteristic described in connection with the embodiment is included in at least an implementation. The appearances of the phrase "in one preferred exemplary embodiment" in various places in the specification are not necessarily all referring to the same embodiment. Thus, although embodiments have been described in language specific to structural features and/or methodological acts, it is to be understood that claimed subject matter may not be limited to the specific features or acts described. Rather, the specific features and acts are disclosed as sample forms of implementing the claimed subject matter.

In conclusion, the present invention provides a technique of analyzing ambient lighting and deriving an ambient luminance value without utilizing an ambient light sensor or any other luminance detecting device. Furthermore, via the step increasing control circuit of the present invention, the ambient luminance value can be used to control the hardware, such as the back light source of an LCD monitor, steadily and stably.

Those skilled in the art will readily observe that numerous modifications and alterations of the device and method may be made while retaining the teachings of the invention.

What is claimed is:

1. An image processing method, comprising:

respectively adjusting a plurality of original luminance values respectively corresponding to a plurality of pixels in a plurality of blocks of an image among an input image stream according to exposure of the image to generate a plurality of luminance values, comprising:

for each pixel of each block in the image:

multiplying a weighting value corresponding to the pixel by a difference value between an exposure value corresponding to the image and an exposure reference to generate a multiplication result; and adding the multiplication result to an original luminance value corresponding to the pixel to generate a luminance value corresponding to the pixel;

generating a plurality of block luminance values respectively corresponding to the plurality of blocks of the image according to the plurality of luminance values respectively corresponding to the plurality of pixels in the plurality of blocks;

configuring each block in the plurality of blocks whose block luminance value is greater than an upper luminance threshold as a light part block;

configuring each block in the plurality of blocks whose block luminance value is smaller than a lower luminance threshold as a dark part block;

discarding the block luminance value of each block that is neither a light part block nor a dark part block;

performing a weighted average calculation upon at least one block luminance value corresponding to a light part block and at least one block luminance value corresponding to a dark part block to generate a first characteristic luminance value; and determining a second characteristic luminance value corresponding to the image according to the plurality of luminance values respectively corresponding to the plurality of pixels of the plurality blocks of the image; and utilizing a determining circuit to determine an ambient luminance value according to the first and second characteristic luminance values.

2. The image processing method of claim 1, wherein:

the step of generating the second characteristic luminance value corresponding to the image comprises:

performing an average calculation upon the plurality of luminance values respectively corresponding to the plurality of pixels of the plurality of blocks of the image to generate the second characteristic luminance value corresponding to the image.

3. The image processing method of claim 1, wherein the step of performing the weighted average calculation to generate the first characteristic luminance value comprises:

performing the weighted average calculation upon a plurality of block luminance values corresponding to a plurality of neighboring and contiguous light part blocks and a plurality of block luminance values corresponding to a plurality of neighboring and contiguous dark part blocks to generate the first characteristic luminance value.

4. The image processing method of claim 1, wherein the step of determining the ambient luminance value comprises:

selecting a maximum value among the first and second characteristic luminance values as the ambient luminance value.

5. The image processing method of claim 1, further comprising:

subtracting the ambient luminance value from a previous step increasing control result according to the input image stream to generate a subtraction result;

performing a clamping operation upon the subtraction result according to a first set of thresholds to generate a first output result;

adding the first output result to the previous step increasing control result to generate an addition result; and performing a clamping operation upon the addition result according to a second set of thresholds to generate a current step increasing control result.

6. An image processing device, comprising:

a block luminance value generation circuit, for generating a plurality of block luminance values respectively corresponding to a plurality of blocks of an image among an input image stream according to a plurality of luminance values respectively corresponding to a plurality of pixels of the plurality of blocks;

an original luminance value adjustment circuit, coupled to the block luminance value generation circuit, for respectively adjusting a plurality of original luminance values respectively corresponding to the plurality of pixels in the plurality of blocks according to the exposure of the image to generate the plurality of luminance values, wherein the original luminance value adjustment circuit performs a luminance adjustment upon each pixel of the plurality of blocks, and the original luminance value adjustment circuit comprises:

a subtracting unit, for generating a difference value between an exposure value corresponding to the image and an exposure reference;

a multiplying unit, coupled to the subtracting unit, for multiplying the difference value by a weighting value corresponding to the pixel to generate a multiplication result; and an adding unit, coupled to the multiplying unit, for adding the multiplication result to an original luminance value corresponding to the pixel to generate a luminance value corresponding to the pixel;

a first characteristic luminance value calculation circuit, coupled to the block luminance value generation circuit, for configuring each block in the plurality of blocks whose block luminance value is greater than the upper luminance threshold as a light part block, configuring each block in the plurality of blocks whose block luminance value is smaller than the lower luminance threshold as a dark part block, discarding the block luminance value of each block that is neither a light part block nor a dark part block and performing a weighted average calculation upon at least one block luminance value corresponding to a light part block and at least one block luminance value corresponding to a dark part block to generate the first characteristic luminance value;

a second characteristic luminance value calculation circuit, for determining a second characteristic luminance value corresponding to the image according to the plurality of luminance values respectively corresponding to the plurality of pixels of the plurality blocks of the image; and a determining circuit, coupled to the first characteristic luminance value calculation circuit and the second characteristic luminance value calculation circuit, for determining an ambient luminance value according to the first and second characteristic luminance values.

7. The image processing device of claim 6, wherein:

the second characteristic luminance value calculation circuit performs an average calculation upon the plurality of luminance values respectively corresponding to the plurality of pixels of the plurality of blocks of the image to generate the second characteristic luminance value corresponding to the image.

8. The image processing device of claim 6, wherein the first characteristic luminance value calculation circuit performs the weighted average calculation upon a plurality of block luminance values corresponding to a plurality of neighboring and contiguous light part blocks and a plurality of block luminance values corresponding to a plurality of neighboring and contiguous dark part blocks to generate the first characteristic luminance value.

9. The image processing device of claim 6, wherein the determining circuit selects a maximum value among the first and second characteristic luminance values as the ambient luminance value.

10. The image processing device of claim 6, further comprising:

a step increasing control unit, for generating a current step increasing control result according to the ambient luminance value, comprising:

a register unit, coupled to a second clamping unit, for temporarily storing a previous step increasing control result which is generated according to the input image stream;

a subtracting unit, coupled to the determining circuit and the register unit, for generating a subtraction result according to the ambient luminance value and the previous step increasing control result;

a first clamping unit, coupled to the subtracting unit, for performing a clamping operation according to the subtraction result and a first set of thresholds to generate a first output result;

an adding unit, coupled to the register unit and the first clamping unit, for adding the first output result to the previous step increasing control result to generate an addition result; and the second clamping unit, coupled to the adding unit and the register unit, for performing a clamping operation according to the addition result and a second set of thresholds to generate the current step increasing control operation result.

* * * * *